US008382309B1

(12) United States Patent
Johnston

(10) Patent No.: US 8,382,309 B1
(45) Date of Patent: Feb. 26, 2013

(54) LIGHT POD SYSTEM

(76) Inventor: David Johnston, Adelaide (AU)

( * ) Notice: Subject to any disclaimer, the term of this patent is extended or adjusted under 35 U.S.C. 154(b) by 236 days.

(21) Appl. No.: 13/018,460

(22) Filed: Feb. 1, 2011

(51) Int. Cl.
*A45C 15/06* (2006.01)

(52) U.S. Cl. ..... 362/156; 362/191

(58) Field of Classification Search ..... 362/156, 362/191, 249.02, 276, 362, 368
See application file for complete search history.

(56) References Cited

U.S. PATENT DOCUMENTS 5,018,057 A 5/1991 Biggs et al.
D402,391 S 12/1998 Manarin
6,857,771 B2 2/2005 Guerrieri
7,021,787 B1 4/2006 Kuelbs
7,172,313 B2 2/2007 Abel et al.
7,207,689 B2 4/2007 Tait
2005/0047120 A1* 3/2005 Sargent ..... 362/156
2008/0204258 A1 8/2008 Dayton et al.

* cited by examiner

*Primary Examiner* — Thuy Vinh Tran
(74) *Attorney, Agent, or Firm* — Kyle Fletcher, Esq.

(57) ABSTRACT

The light pod system is an illumination assembly that is placed in a handbag or a purse and when touched illuminates the interior to aid an end user in seeing the contents contained within the purse or handbag. The light pod system consists of a sleek housing that is slim and of which includes a plurality of light emitting diodes, which all illuminate once the housing is touched by an end user. The housing also includes a timer that can adjust the duration of illumination. An optional remote control can turn on the system without the need to actually touch the housing.

18 Claims, 5 Drawing Sheets

LIGHT POD SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of lighting systems, more specifically, a portable light that can be placed within a purse or handbag and of which illuminates the interior.

B. Discussion of the Prior Art

As will be discussed immediately below, no prior art discloses an illumination assembly that has a sleek overall appearance that is simply dropped into a bottom of a handbag or a purse and of which illuminates when touched by an end user; wherein a plurality of light emitting diodes adorn an exterior surface of the device; a timer is located on an end of the device and can adjust the duration of illumination of the light emitting diodes; and wherein the device may include a plurality of individual light pods that illuminate upon receipt of a wireless signal after use of the touch sensor.

The Dayton et al. Patent Application Publication (U.S. Pub. No. 2008/0204258) discloses a system and method for navigating in low light and may comprise providing a light integrated in an object, associating the light with a power source, associating the light with a motion and light sensitive trigger, and powering the light when the motion-trigger senses motion and the light-trigger senses low light. However, the system and method are directed to offering low light in navigation and not an accessory that fits within a handbag or purse and when touched by an end user illuminates for a predefined amount of time.

The Tait Patent (U.S. Pat. No. 7,207,689) discloses a touch-activated purse illumination assembly having a base unit housing a circuit assembly, a power source, and at least one elongated light emitting portion. However, the illumination assembly fails to include a timer or circuitry as disclosed below.

The Kuelbs Patent (U.S. Pat. No. 7,021,787) discloses an outdoor lighting system wherein a wireless receiver and transmitter pair may be utilized to allow an operator to use a wireless command signal to change the operating state. However, the lighting system is not directed to an illumination assembly that has a sleek overall appearance that fits within a handbag or purse and when touched by an end user illuminates for an amount of time designated by the timer.

The Abel et al. Patent (U.S. Pat. No. 7,172,313) discloses a flashlight that is adapted to allow electric current to flow from the power source through the light source when both of the two nodes are abutted by a user's hand, activating the flashlight without further manipulation required by the end user. Again, the flashlight is not directed to an illumination assembly that has a sleek overall appearance that fits within a handbag or purse and when touched by an end user illuminates for an amount of time designated by the timer.

The Biggs et al. Patent (U.S. Pat. No. 5,018,057) discloses a touch initiated light module that may be used to illuminate a purse. However, the touch initiated light module is integrated into a side surface of a handbag or purse and not simply dropped inside of a handbag or purse and upon touching by an end user illuminates for an amount of time that can be adjusted via a timer located on an end of the housing.

The Guerrieri Patent (U.S. Pat. No. 6,857,771) discloses a light stick formed from an elongated, light-transmitting member having a plurality of grooves formed in it's exterior surface and an aperture at one end for receiving a light source, such as a light emitting diode. However, the light stick does not have a means to illuminate upon being touched by an end user, or include a timer to adjust the duration of illumination when touched by an end user.

While the above-described devices fulfill their respective and particular objects and requirements, they do not describe an illumination assembly that has a sleek overall appearance that is simply dropped into a bottom of a handbag or a purse and of which illuminates when touched by an end user; wherein a plurality of light emitting diodes adorn an exterior surface of the device; a timer is located on an end of the device and can adjust the duration of illumination of the light emitting diodes; and wherein the device may include a plurality of individual light pods that illuminate upon receipt of a wireless signal after use of the touch sensor. In this regard, the light pod system departs from the conventional concepts and designs of the prior art.

SUMMARY OF THE INVENTION

The light pod system is an illumination assembly that is placed in a handbag or a purse and when touched illuminates the interior to aid an end user in seeing the contents contained within the purse or handbag. The light pod system consists of a sleek housing that is slim and of which includes a plurality of light emitting diodes, which all illuminate once the housing is touched by an end user. The housing also includes a timer that can adjust the duration of illumination. An alternative embodiment employs a plurality of light pods that illuminate upon receipt of a wireless signal that is transmitted after use of the touch sensor.

An object of the invention is to provide a light that fits within a purse or handbag and once touched will illuminate for a predefined amount of time.

A further object of the invention is to provide a timer on the housing that can adjust the duration of the illumination of the light emitting diodes.

A further object of the invention is to provide a housing that slim and sleek and does not take up a lot of space within a handbag or purse.

A further object of the invention is to provide a plurality of light pods that each include powering means and a receiver and illuminate for a predetermined amount of time upon receipt of a wireless signal that is transmitted only after a touch sensor is used.

These together with additional objects, features and advantages of the light pod system will be readily apparent to those of ordinary skill in the art upon reading the following detailed description of presently preferred, but nonetheless illustrative, embodiments of the light pod system when taken in conjunction with the accompanying drawings.

In this respect, before explaining the current embodiments of the light pod system in detail, it is to be understood that the light pod system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the light pod system.

It is therefore important that the claims be regarded as including such equivalent construction insofar as they do not depart from the spirit and scope of the light pod system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 2 illustrates a front, isometric view of the light pod system with a battery compartment unsealed and the batteries exploded there from;

FIG. 3 illustrates an end user touching the light pod system, and depicting light being emitted there from;

DETAILED DESCRIPTION OF THE EMBODIMENT

Figure 1:
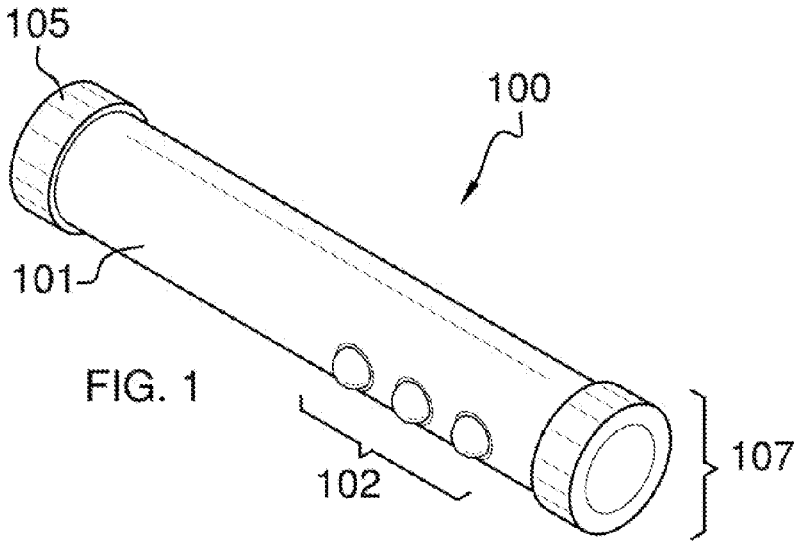
FIG. 1 illustrates a front, isometric view of the light pod system by itself.
Figure 2:
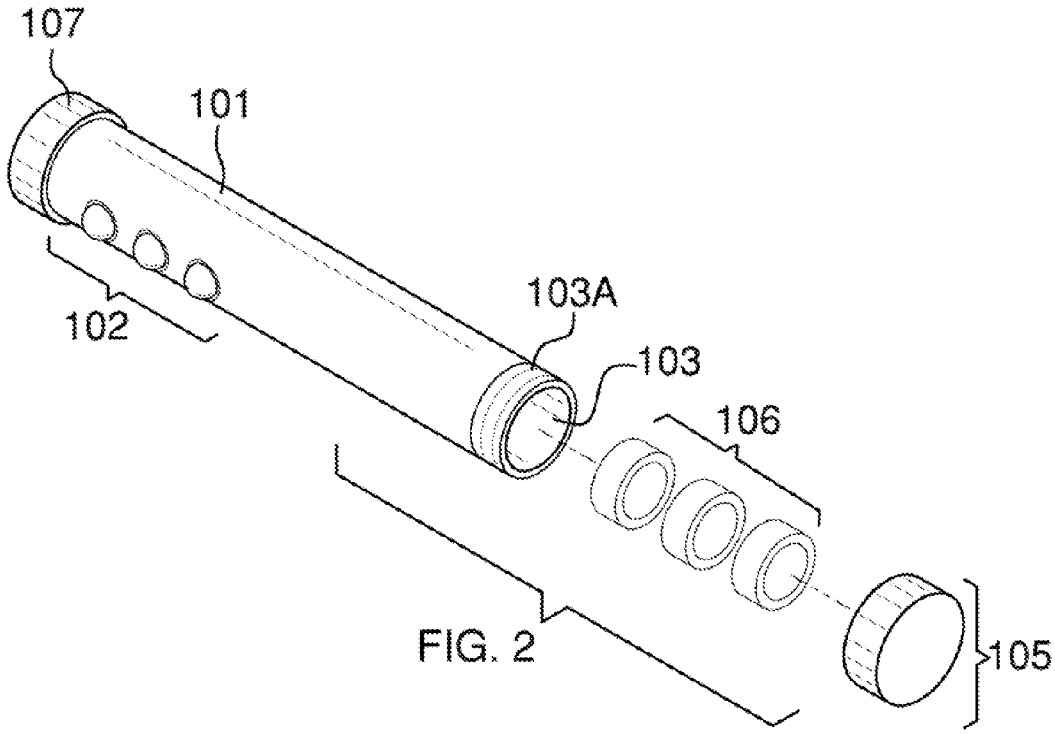

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A light pod system 100 (hereinafter invention) includes a housing 101 upon which a plurality of light emitting diodes 102 are located. The light emitting diodes 102 are aligned and run lengthwise along the housing 101.

The housing 101 is made of stainless steel, is of cylindrical geometry, and includes a first end 103 and a second end 104. The first end 103 has external threading 103A and is capped off via a battery cap 105. The battery cap 105 screws onto the first end 103 and encloses a battery compartment that includes at least one battery 106 therein.

Figure 3:
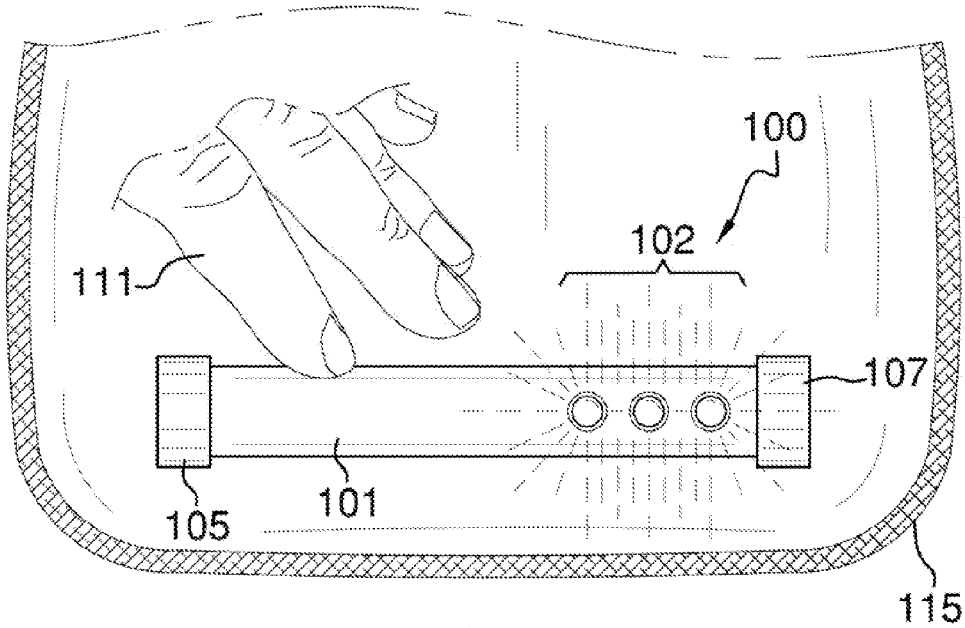
Figure 4:
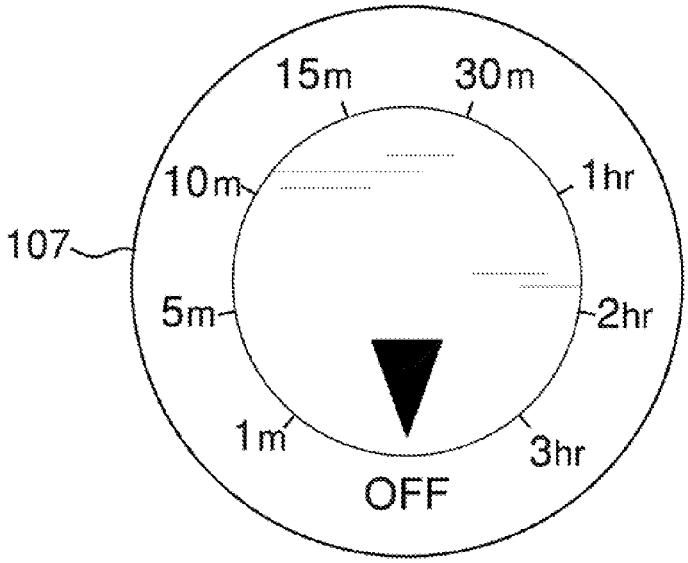
FIG. 4 illustrates a view of a timer used to set the range of time that the light stays illuminated after being touched by an end user.

Located on the second end 104 is a timer 107 which can adjust the duration that the light emitting diodes 102 remain illuminated once the housing 101 is touched (see FIGS. 3 and 4). Referring to FIG. 4, the timer 107 can adjust the duration of illumination from 0 minutes to 3 hours.

Located within the housing 101 is a central processing unit 108 (hereinafter CPU), which is responsible for controlling all functions associated with the invention 100. The CPU 108 is wired to the timer 107, is wired to the battery(s) 106, is wired to the light emitting diodes 102, is wired to a touch sensor 109, and may be wired to a receiver 110.

The touch sensor 109 is a technology that is not new to the world, but is being incorporated in the invention 100. The touch sensor 109 enables the housing 101 to act as a switch to detect the touching the housing 101 by an end user 111.

Figure 6:
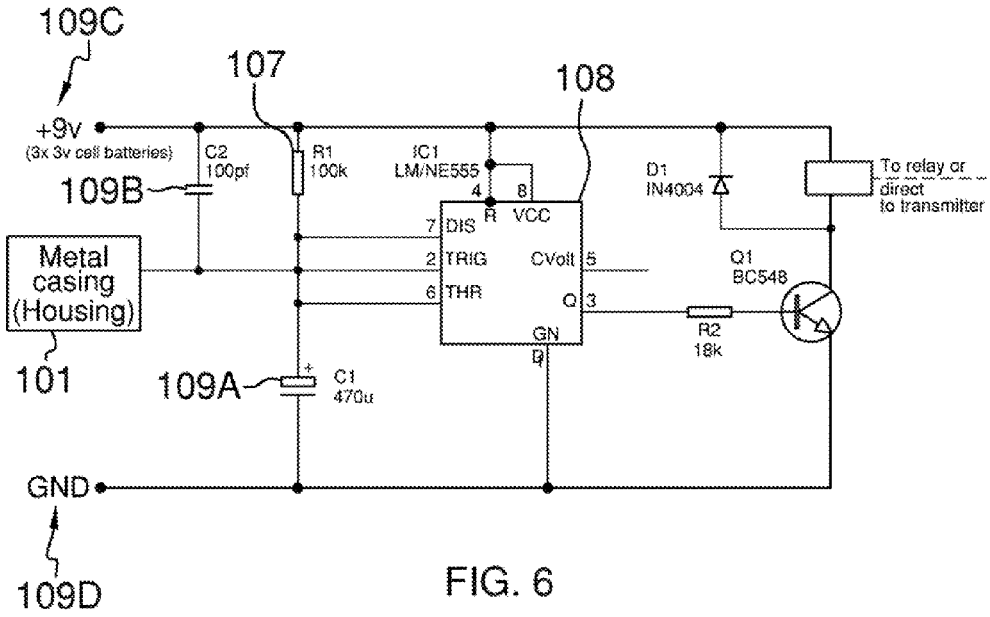
FIG. 6 illustrates a circuit diagram of the touch plate and timer circuitry used in the light pod system.

Referring to FIG. 6, the touch sensor 109 involves wiring the housing 101, which forms a circuit that starts the timer 107 counting the time with which the light emitting diodes 102 are illuminated via the CPU 108.

The touch sensor 109 is composed of a first capacitor 109A and a second capacitor 109B that are wired in between a positive lead 109C and a negative lead 109D. The first capacitor 109A is wired to the negative lead 109D or ground. The second capacitor 109B is wired to the positive lead 109C.

Figure 5:
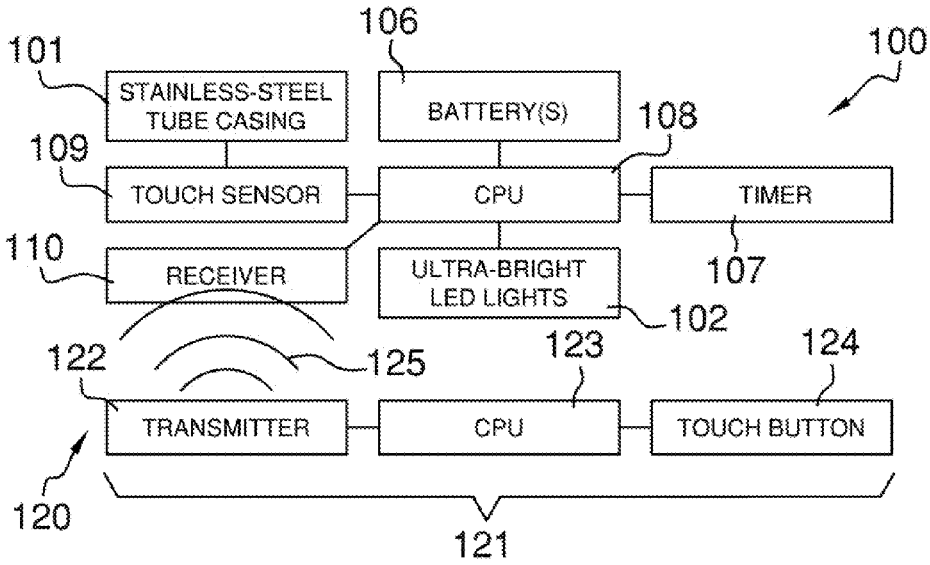
FIG. 5 illustrates a diagram of the various components of the light pod system.

Referring to FIG. 5, an alternative embodiment 120 of the invention 100 includes a remote control 121 that includes a transmitter 122, a second central processing unit 123 (hereinafter second CPU), and a touch button 124.

The transmitter 122 emits a signal 125 that is received by the receiver 110, and in turn communicates the signal 125 to the CPU 108 thereby illuminating the light emitting diodes 102.

The invention 100 is designed to be placed inside of a handbag 115 or a purse, and can simply lie along a bottom portion of the handbag 115, until the invention 100 is touched by the end user 111. Thus, the housing 101 must be durable, slim, and sleek in shape.

The alternative embodiment 120 may be a small remote control 121 that appears in a hand and is operated by depressing the touch button 124. Alternatively, the remote control 121 may be integrated into the design of the purse or handbag and may simply appear as a button or clip on the purse or handbag, and upon which an end user pushes thereon and effectively pushes the touch button 124 to activate the transmitter 122 located inside. As per the alternative embodiment 120, the housing 101 acts as antennae for the receiver 110.

Figure 7:
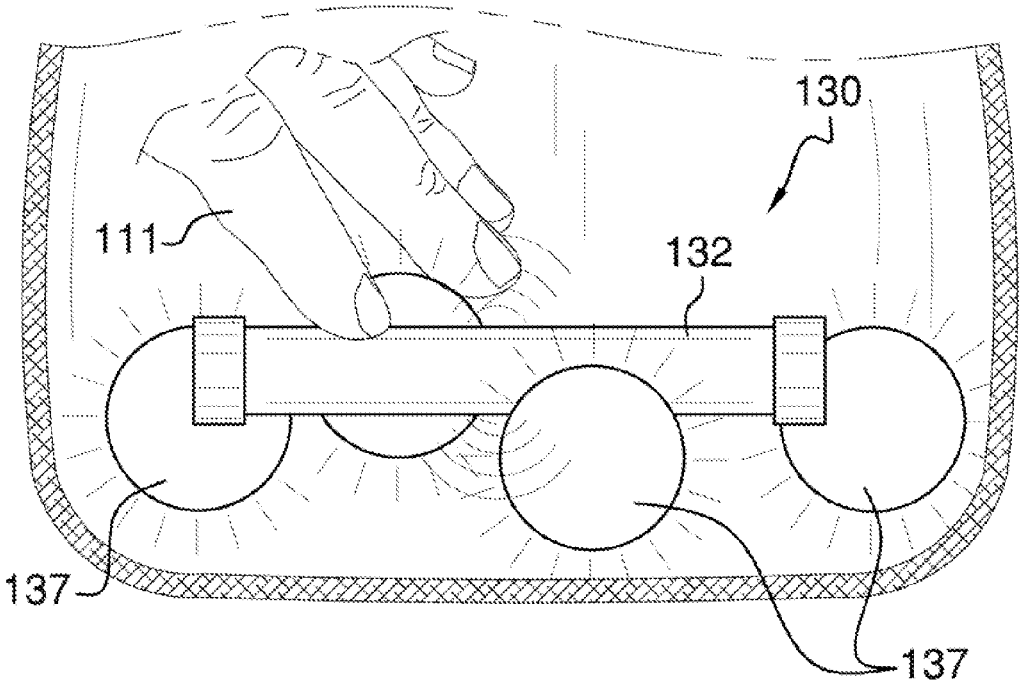
FIG. 7 illustrates a light pods embodiment in which an end user touching the touch sensor, which in turn emits a signal that is received by individual light pods surrounding the touch sensor, which in turn emit light individually.
Figure 8:
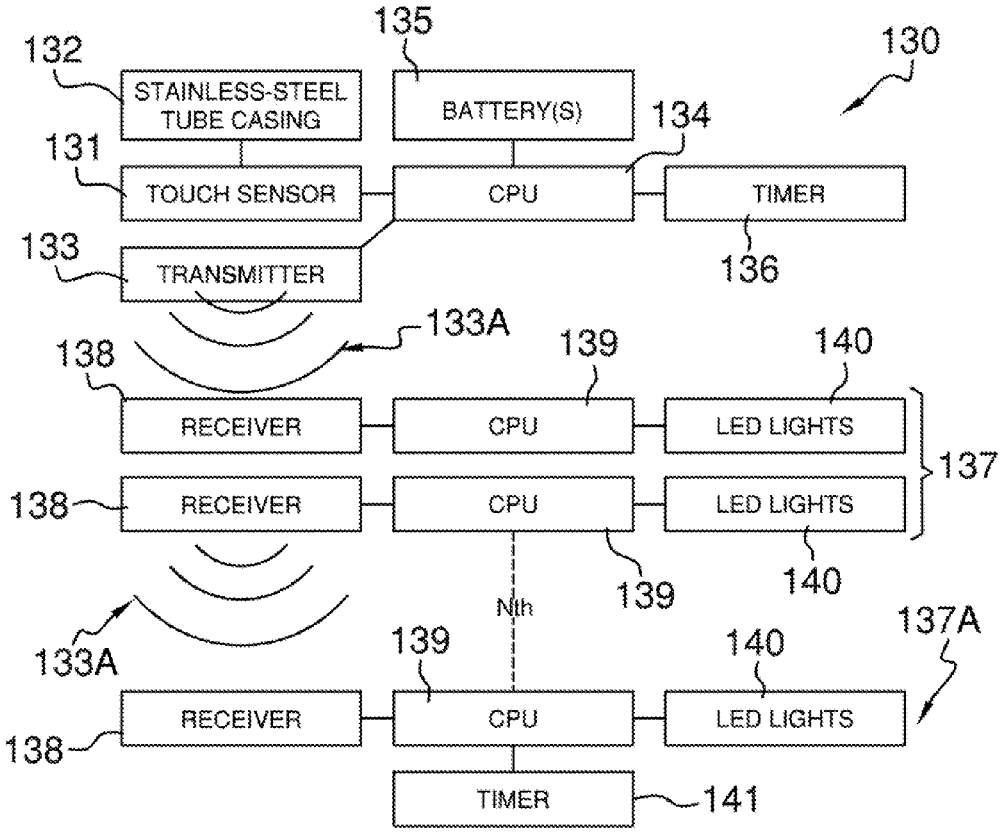
FIG. 8 illustrates a diagram of the various components of the light pods embodiment of the light pod system.

Referring to FIGS. 7 and 8, a light pods embodiment 130 includes a touch sensor 131 encased within a housing 132. The touch sensor 131 is the same as the touch sensor 109 of the invention 100 described above. The touch sensor 131 detects the touch of the end use 111 (see FIG. 7), and emits a signal 133A via a transmitter 133, which is located within the housing 132. The touch sensor 131 is wired to a central processing unit 134 (hereinafter CPU). The CPU 134 is wired to a powering means 135 and a timer 136.

The powering means 135 provides power to all of the components contained within the housing 132. The timer 136 performs a timing function, which determines the duration with which the transmitter 133 transmits the signal 133A. The CPU 134 controls all functions associated with the touch sensor 131 and the transmitter 133.

A plurality of light pods 137 are placed adjacent the housing 132. Each light pod 137 includes a receiver 138, a central processing unit 139, and at least one light emitting diode 140.

The light pods 137 are encased within a housing, which is translucent such that the light output of the light emitting diode(s) 140 is visible from outside of the housing.

Upon touching the touch sensor 131, the CPU 134 transmits the signal 133A via the transmitter 133 of a period of time defined by the timer 136. During said period of time, all light pods 137 able to receive the signal 133A via the receiver 138, will illuminate the light emitting diode(s) 140 until the signal 133A is no longer received via the receiver 138.

Additionally, the light pods embodiment 130 may employ a modified light pod 137A, which includes a timer 141 within. The inclusion of the timer 141 leaves the responsibility of duration of illumination up to the individual light pod and not the timer 136 associated with the touch sensor 131 as discussed above. This being the case, it may be the responsibility of the individual modified light pods 137A to dictate the duration of illumination, which can give the end user 111 a plurality of options.

Should the modified light pods 137A be employed, the respective timers 141 may be set at different intervals in order to give an illuminating effect such that as time elapses, the modified light pods 137A would turn off consecutively, and indicate to the end user 111 that time is running out before the illumination ceases.

With respect to the above description, it is to be realized that the optimum dimensional relationship for the various components of the invention 100 the alternative embodiment 120 and the light pods embodiment 130, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100 the alternative embodiment 120 and the light pods embodiment 130.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A light pod system comprising:

a housing upon which a plurality of light emitting diodes are mounted and wired to a central processing unit (hereinafter CPU);

wherein a timer and at least one battery are wired to the CPU;

wherein a battery compartment is located at a first end of the housing and includes a battery cap that seals off the battery compartment;

wherein a touch sensor is wired to the housing and upon touching the housing, a circuit is formed to the CPU, which illuminates the light emitting diodes for an amount of time defined by the timer;

wherein the housing is placed within a handbag and only illuminates when touched by an end user.

2. The light pod system as described in claim 1 wherein the housing is made of a stainless steel.

3. The light pod system as described in claim 1 wherein the plurality of light emitting diodes are aligned with one another and run lengthwise along the housing.

4. The light pod system as described in claim 1 wherein the first end has external threading along an exterior surface that is used to screw on the battery cap in order to seal off the battery compartment.

5. The light pod system as described in claim 1 wherein the timer can adjust the duration of illumination of the light emitting diodes from 0 minutes to 3 hours.

6. The light pod system as described in claim 1 wherein the central processing unit is wired to a receiver that can receive signals from a remote control; wherein the remote control includes a second central processing unit (hereinafter second CPU), a touch button wired to the second CPU, and a transmitter wired to the second CPU; whereupon depression of the touch button, the transmitter emits a signal that is received via the receiver, and in which signals the CPU to illuminate the light emitting diodes.

7. The light pod system as described in claim 6 wherein the housing is wired to and is an antenna for the receiver.

8. A light pod system comprising:

a housing upon which a plurality of light emitting diodes are mounted and wired to a central processing unit (hereinafter CPU) located within the housing;

wherein a timer is located on a second end of the housing and is wired to the CPU;

wherein a battery compartment is located at a first end of the housing and includes a battery cap that seals off the battery compartment, which includes at least one battery wired to the CPU;

wherein a touch sensor is wired to the housing and upon touching the housing, a circuit is formed to the CPU, which illuminates the light emitting diodes for an amount of time defined by the timer;

wherein the housing is placed within a handbag and only illuminates when touched by an end user;

wherein the central processing unit is wired to a receiver that can receive signals from a remote control; wherein the remote control includes a second central processing unit (hereinafter second CPU), a touch button wired to the second CPU, and a transmitter wired to the second CPU; whereupon depression of the touch button, the transmitter emits a signal that is received via the receiver, and in which signals the CPU to illuminate the light emitting diodes.

9. The light pod system as described in claim 8 wherein the housing is made of a stainless steel.

10. The light pod system as described in claim 8 wherein the plurality of light emitting diodes are aligned with one another and run lengthwise along the housing.

11. The light pod system as described in claim 8 wherein the first end has external threading along an exterior surface that is used to screw on the battery cap in order to seal off the battery compartment.

12. The light pod system as described in claim 8 wherein the timer can adjust the duration of illumination of the light emitting diodes from 0 minutes to 3 hours.

13. The light pod system as described in claim 8 wherein the housing is wired to and is an antenna for the receiver.

14. A light pod system comprising:

a housing into which a timer, a transmitter, and at least one battery are wired to a CPU;

wherein a touch sensor is wired to the housing and upon touching the housing, a circuit is formed to the CPU, which transmits a signal via the transmitter for an amount of time defined by the timer;

wherein the housing is placed within a handbag and only illuminates when touched by an end user;

wherein at least one light pod is placed within said handbag and adjacent to the housing;

wherein the light pod includes a translucent housing containing a receiver, central processing unit, and at least one light emitting diode;

as long as the receiver receives the signal of the transmitter, the light pod emits light via the light emitting diode.

15. The light pod system as described in claim 14 wherein the housing is made of a stainless steel.

16. The light pod system as described in claim 14 wherein the timer can adjust the duration of illumination of the light emitting diodes from 0 minutes to 3 hours.

17. The light pod system as described in claim 14 wherein the light pod is modified to include a timer that will dictate the internal of time that the light emitting diode emits light through the translucent housing.

18. The light pod system as described in claim 17 wherein the timer can adjust the duration of illumination of the light emitting diodes from 0 minutes to 3 hours.

* * * * *